US008857973B2

(12) United States Patent
Wada

(10) Patent No.: US 8,857,973 B2
(45) Date of Patent: Oct. 14, 2014

(54) SHEET CONVEYING DEVICE AND RECORDING APPARATUS

(75) Inventor: Itaru Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/191,338

(22) Filed: Jul. 26, 2011

(65) Prior Publication Data

US 2012/0050438 A1 Mar. 1, 2012

(30) Foreign Application Priority Data

Aug. 26, 2010 (JP) ..... 2010-189459

(51) Int. Cl.

| | |
|---|---|
| ***B41J 2/01*** | (2006.01) |
| ***B65H 23/195*** | (2006.01) |
| *B41J 15/16* | (2006.01) |
| *B41J 11/42* | (2006.01) |

(52) U.S. Cl.

CPC ..... *B65H 23/1955* (2013.01); *B41J 15/165* (2013.01); *B65H 2511/12* (2013.01); *B65H 2403/732* (2013.01); *B65H 2511/142* (2013.01); *B41J 11/425* (2013.01)

USPC ..... 347/104; 347/101

(58) Field of Classification Search

CPC ..... B41J 11/007; B41J 11/06; B41J 11/0085

USPC ..... 242/528; 271/273; 400/614, 613; 399/45, 92; 347/104, 101

See application file for complete search history.

(56) References Cited

U.S. PATENT DOCUMENTS

| | | | | |
|---|---|---|---|---|
| 3,885,749 | A * | 5/1975 | Skacel | 242/420 |
| 6,193,183 | B1 * | 2/2001 | Yoshizawa | 242/334.3 |
| 2002/0113160 | A1 * | 8/2002 | Niioka et al. | 242/528 |
| 2003/0062440 | A1 * | 4/2003 | Ohshio et al. | 242/528 |
| 2008/0107468 | A1 * | 5/2008 | Silverbrook et al. | 400/613 |
| 2009/0226235 | A1 * | 9/2009 | Kobayashi et al. | 400/614 |
| 2010/0090396 | A1 * | 4/2010 | Shinjo et al. | 271/273 |
| 2010/0254721 | A1 * | 10/2010 | Fukita et al. | 399/44 |

FOREIGN PATENT DOCUMENTS

JP 2007-253361 A 10/2007

* cited by examiner

*Primary Examiner* — Manish S Shah
*Assistant Examiner* — Yaovi Ameh
(74) *Attorney, Agent, or Firm* — Canon USA, Inc., IP Division

(57) ABSTRACT

A sheet conveying device having a rolled-sheet supporting unit, a conveying unit, a driving unit, a tension applying unit, and a control unit. The rolled-sheet supporting unit supports a continuous sheet rolled up into a roll. The conveying unit conveys the continuous sheet from the rolled-sheet supporting unit as driven by the driving unit. The tension applying unit applies tension to the continuous sheet downstream of the conveying unit in a conveying direction. The control unit controls a driving amount of the driving unit per unit conveyance distance as the conveying unit conveys the continuous sheet. The driving amount is larger in a case where a first tension is applied by the tension applying unit compared to a case in which a second tension, that is larger than the first tension, is applied.

20 Claims, 6 Drawing Sheets

SHEET CONVEYING DEVICE AND RECORDING APPARATUS

BACKGROUND OF THE INVENTION

1. Field of the Invention

The present invention relates to a sheet conveying device and recording apparatus capable of correcting a conveyance length of a continuous sheet.

2. Description of the Related Art

In a recording apparatus, when a continuous sheet, which is a medium, is conveyed, the surface of the sheet may slip on a conveyer part, causing the conveyance length to deviate from a target value. In such a case, lines may be formed during printing, reducing the printing quality. Thus, the driven amount of the conveying mechanism must be corrected so that the conveyance length is set to the target value. When conveying a rolled sheet, the sheet slippage during conveyance may vary in accordance with the remaining amount of rolled sheet. For example, when the remaining amount of the rolled sheet is large, the slippage is large due to the effect of the inertia brake of the rolled sheet, whereas when the remaining amount of the rolled sheet is small, the slippage is small because the effect of the inertia brake of the rolled sheet is small. There is a known apparatus including a rolled-sheet feeding part equipped with a torque limiter. The apparatus is capable of performing skew correction of a sheet by applying a braking force to the sheet. With such an apparatus, at constant torque, when the diameter of the rolled sheet is large, the braking force is small, whereas when the diameter of the rolled sheet is small, the braking force is large.

Japanese Patent Laid-Open No. 2007-253361 discloses a technique of correcting a driving amount in response to the remaining amount of a rolled sheet.

In a recording apparatus, in some cases, a recording medium is spooled into a roll while applying tension to the recording medium for reasons such as facilitating the handling of the recorded medium or supporting the conveyance. For example, in a recording apparatus that spools a medium at constant torque using a torque limiter, the tension applied to the recording medium varies as the diameter of the rolled sheet changes. Such variation in tension causes the medium conveyance length to deviate from a target value, reducing the printing quality. Thus, for a recording apparatus that has a spooling conveyance mechanism, conveyance must be corrected in accordance with the variation in tension.

SUMMARY OF THE INVENTION

The present invention provides a sheet conveying device that conveys a continuous sheet while applying tension at a position downstream of a conveying unit and that can prevents slippage of the sheet being conveyed due to tension.

According to an aspect of the present invention, a sheet conveying device includes: a rolled-sheet supporting unit configured to support a continuous sheet rolled up into a roll; a conveying unit configured to convey the continuous sheet from the rolled-sheet supporting unit; a driving unit configured to drive the conveying unit; a tension applying unit configured to apply tension to the continuous sheet downstream of the conveying unit in a conveying direction; and a control unit configured to control a driving amount of the driving unit per unit conveyance distance as the conveying unit conveys the continuous sheet, wherein the driving amount is larger in a case where a first tension is applied by the tension applying unit compared to a case in which a second tension, that is larger than the first tension, is applied.

The present invention provides a sheet conveying device that conveys a continuous sheet while applying tension at a position downstream of a conveying unit and that can prevents slippage of the sheet being conveyed due to tension.

Further features of the present invention will become apparent from the following description of exemplary embodiments with reference to the attached drawings.

DESCRIPTION OF THE EMBODIMENTS

Embodiments of the present invention will be described below with reference to the drawings.

First Embodiment

Recording Apparatus

Figure 1:
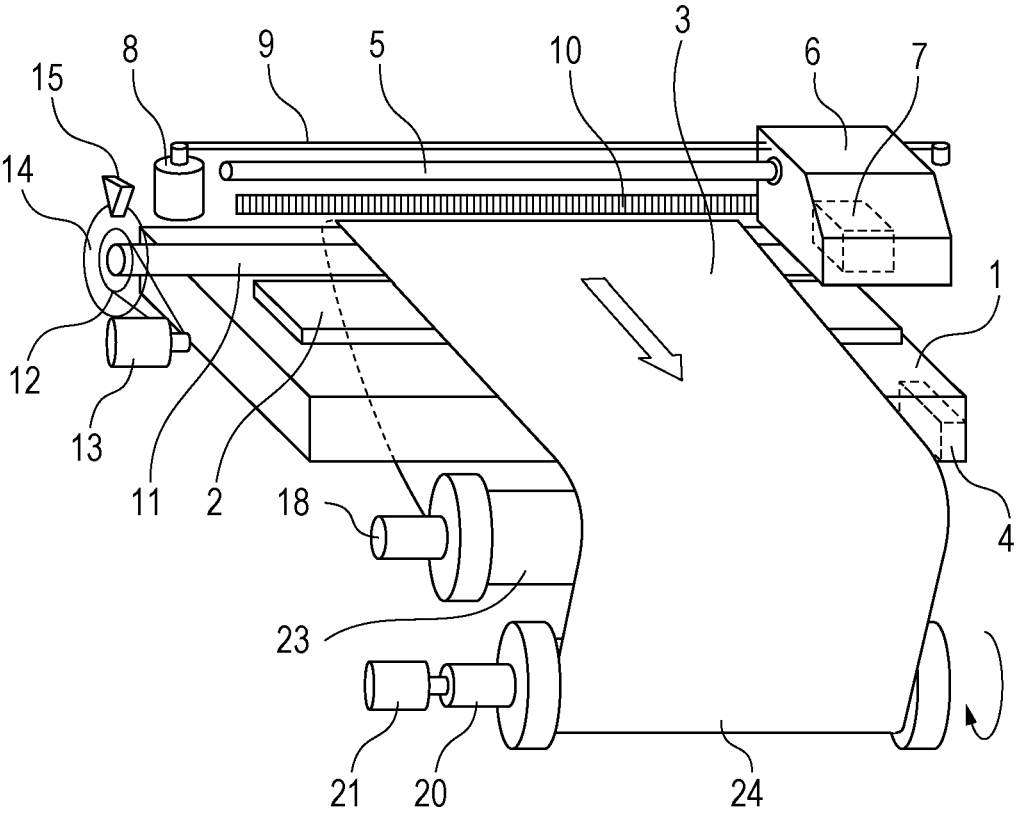
FIG. 1 is a perspective view of a recording apparatus.
Figure 2:
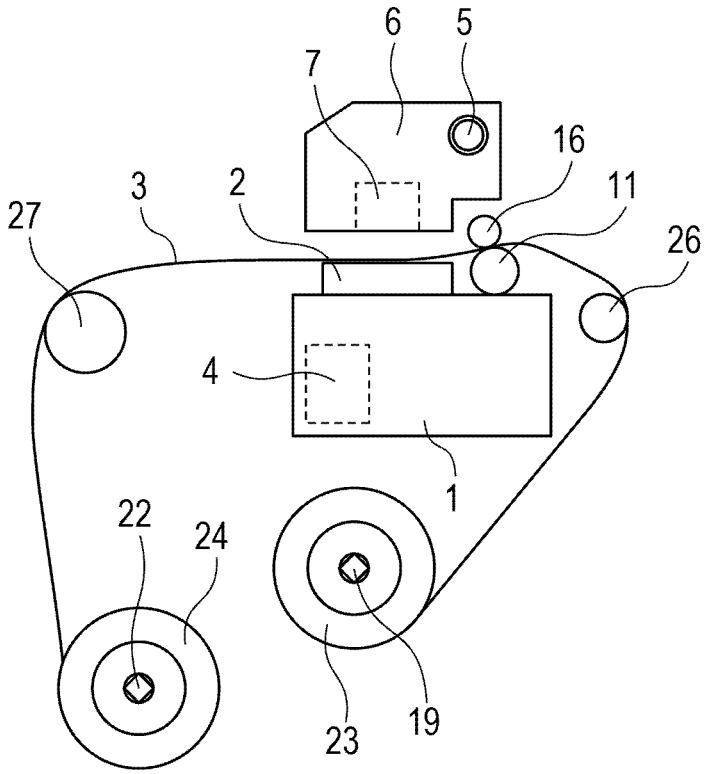
FIG. 2 is side view of the recording apparatus.

FIG. 1 is a perspective view of the essential parts of a recording apparatus. FIG. 2 is a side view of the essential parts of the recording apparatus. A housing 1 is disposed inside the recording apparatus. A platen 2 is disposed on the housing 1. The housing 1 accommodates a suction device 4 that sucks a sheet medium 3 against the platen 2. A carriage 6 that reciprocates in the main scanning direction is supported by a main rail 5 disposed along the longitudinal direction of the housing 1. The carriage 6 has an inkjet print head 7, which is a recording unit. The print head 7 may employ various different inkjet systems, such as a system using a heat emitting body, a piezoelectric device, an electrostatic actuator, or an MEMS device. A carriage motor 8 is a driving source for moving the carriage 6 in the main scanning direction. The rotational driving force is transmitted to the carriage 6 via a belt 9. The position of the carriage 6 in the main scanning direction is detected and monitored by a linear encoder. The linear encoder includes a linear encoder pattern 10 that is attached to the housing 1 and a reading unit (not shown) that is mounted on the housing 1 and optically, magnetically, or mechanically reads the encoder pattern 10.

The sheet conveying device will be described below. The medium 3 is a continuous sheet spooled onto a feeding spool 18, which is a rolled-sheet supporting unit. The continuous sheet spooled onto the feeding spool 18 is guided by a guide roller 26 and is conveyed by a conveying roller 11, which is a conveying unit. The feeding spool 18 includes a torque limiter 19. The torque limiter 19 applies torque resisting the rotation of the roll when the continuous sheet is conveyed by the conveying roller 11. The torque is substantially constant. The torque applied to the feeding spool 18 when conveying the medium 3 is substantially constant. As a result, tension (braking force) is applied to the medium 3 between the nip of the conveying roller 11 and a feeding sheet roll 23.

The conveying direction of the medium 3 is the sub scanning direction (indicated by the arrow in FIG. 1) orthogonal to the main scanning direction of the carriage 6. Conveyance is enabled by the conveying roller 11 and a pinch roller 16. The conveying roller 11 is driven by a conveying motor 13, which is a driving unit, via a belt 12. The driving state (rotated amount, rotational speed, and driven amount by the conveying motor 13) of the conveying roller 11 is detected and monitored by a rotary encoder. The rotary encoder includes a disk encoder pattern 14 that rotates together with the conveying roller 11 and a reading unit 15 that optically, magnetically, or mechanically reads the encoder pattern 14.

After printing is performed by the print head 7 on the medium 3, the medium 3 is conveyed by a turn roller 27 and spooled onto a roll-up spool 20 into a roll-up sheet roll 24. The roll-up spool 20 is rotationally driven by a roll-up motor 21 with a torque limiter 22 in the direction in which the continuous sheet is spooled onto the roll-up spur 20. The roll-up motor 21 applies constant torque to the roll-up spool 20 by the torque limiter 22. As a result, tension (spooling force) is applied to the medium 3 between the nip of the conveying roller 11 and the roll-up sheet roll 24. The roll-up spool 20, the torque limiter 22, and the roll-up motor 21 constitute a tension applying unit that applies tension to the continuous sheet.

To convey the medium 3 by a predetermined length, the conveying motor 13 is driven, the encoder pattern 14 is read by the reading unit 15, and the conveying motor 13 is driven for a predetermined number of pulse counts. For example, when performing 8-pass printing with an inkjet printer having a head length of one inch (25.4 mm), the target conveyance distance (unit conveyance length) in a single printing action is 3.175 mm. If the resolution of the encoder pattern 14 is 2400 dpi, the distance corresponding to one pulse count is 0.01058 mm. Therefore, by driving the conveying motor 13 for 300 pulse counts, the medium 3 will be conveyed by the target distance.

The unit conveyance distance is the conveyance distance corresponding to one scanning action in recording by the print head 7.

Since the medium 3 receives a braking force from the feeding sheet roll 23 and a spooling force from the roll-up sheet roll 24 while being conveyed, the medium 3 slips on the conveying roller 11. Such slippage causes the actual conveyance distance to become smaller than a target conveyance distance. By correcting the theoretical driving pulse in response to the two different types of tension (braking force and spooling force), the actual conveyance distance can be set substantially equal to the target conveyance distance. By setting a conveyance distance that approximates the target value, high quality printing is achieved. Since the slippage of the medium 3 depends on the medium width, when using a medium having a different width, the driving amount of the motor must be corrected in accordance with the braking force and spooling force per medium unit width. The braking force per unit width applied to the medium 3 can be determined using the following expression: (unit-width braking force)=(feeding torque)/(diameter of feeding sheet roll 23)×(medium width). The spooling force per unit width can be determined using the following expression: (unit-width spooling force)=(roll-up torque)/(diameter of roll-up sheet roll 24)×(medium width). Thus, the medium 3 is conveyed by a predetermined length as a result of correcting the conveyance on the basis of a correction value corresponding to the diameter of the feeding sheet roll 23, the diameter of the roll-up sheet roll 24, and the medium width, enabling high-quality printing.

Conveyance Correction

As in Table 1, appropriate drive correction values corresponding to different medium widths are experimentally determined in advance for the diameter of the feeding sheet roll 23 (feeding diameter) and the diameter of the roll-up sheet roll 24 (roll-up diameter), which are categorized into "large," "medium," and "small." For example, when the feeding diameter is "large" and the roll-up diameter is "small," the appropriate drive correction value is 10 pulse counts. In other words, the conveying motor 13 is driven by 310 pulse counts, which is the sum of the theoretical pulse count 300 and the correction pulse count 10, to approximate the actual conveyance distance to the target conveyance distance.

TABLE 1

| | Roll-up diameter | | | |
|---|---|---|---|---|
| Feeding diameter | Small (40 to 55 mm) | Medium (55 to 70 mm) | Large (70 to 85 mm) | No spooling |
| Small (40 to 55 mm) | 3 | 4 | 6 | 8 |
| Medium (55 to 70 mm) | 7 | 8 | — | 12 |
| Large (70 to 85 mm) | 10 | — | — | 15 |

For example, "small," "medium," and "large" of the feeding diameter and the roll-up diameter respectively correspond to "40 to 55 mm," "55 to 70 mm," and "70 to 85 mm." If the measured diameters of the feeding sheet roll 23 and the roll-up sheet roll 24 are respectively 80 mm and 42 mm, the feeding diameter is "large," and the roll-up diameter is "small." Thus, "10" is selected as the correction value. As the printing action proceeds, the medium 3 is conveyed, changing the diameters of the rolls. For example, if the diameter of the feeding sheet roll 23 becomes 65 mm and the diameter of the roll-up sheet roll 24 becomes 63 mm, both the feeding diameter and the roll-up diameter are "medium," and 8 pulse counts is used as the correction value. By using an appropriate conveyance correction value, high-quality printing is achieved. In this embodiment, a combination of feeding diameter and roll-up diameter, such as "large" and "large," that will cause the roll-up diameter to exceed "large" and exceed the guaranteed roll-up diameter when printing is continued is prohibited and thus not included in the table.

The feeding diameter and the roll-up diameter are calculated from, for example, the initially measured roll diameter, the conveyance distance, and the sheet thickness. For printing in a spooling system, the sectional area of the rolled sheet is constant before and after being conveyed. Accordingly, the current feeding diameter and the current roll-up diameter can be determined by the following expressions.

$$\text{current feeding diameter} = \left(\text{initial feeding diameter}^2 - \frac{\text{conveyance distance} \times \text{sheet thickness}}{\pi}\right)^{1/2} \quad (1)$$

-continued $$\text{current roll-up diameter} = \left(\text{initial roll-up diameter}^2 + \frac{\text{conveyance distance} \times \text{sheet thickness}}{\pi}\right)^{1/2} \quad (2)$$

A table similar to Table 1 is prepared for the sheet width of every medium usable by the recording apparatus and is stored in a memory. When conveying a medium, a correction value appropriate for the type and width of medium to be used is read out from the table to correct the driving amount of the motor.

Figure 3:
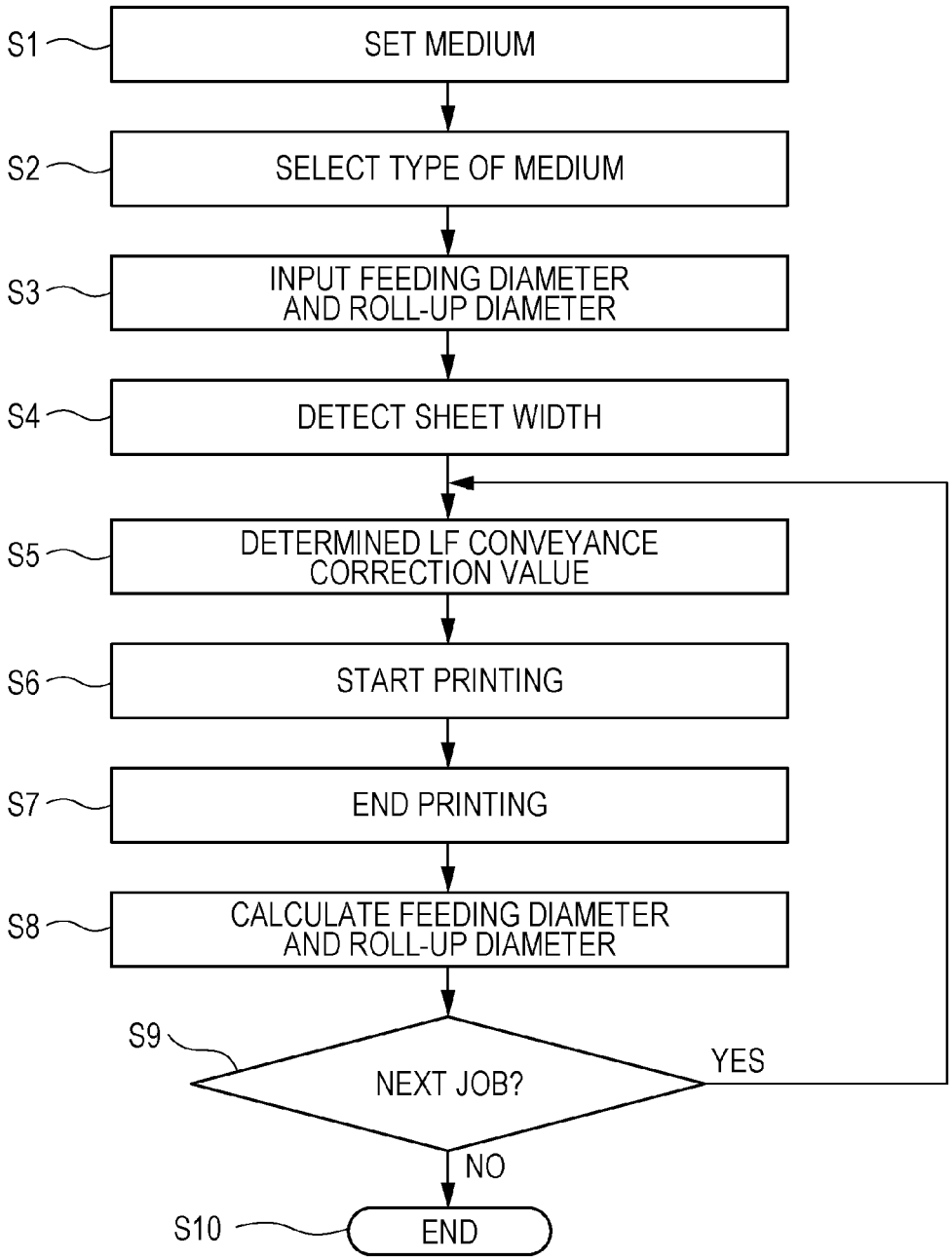
FIG. 3 is flow chart for printing.
Figure 4:
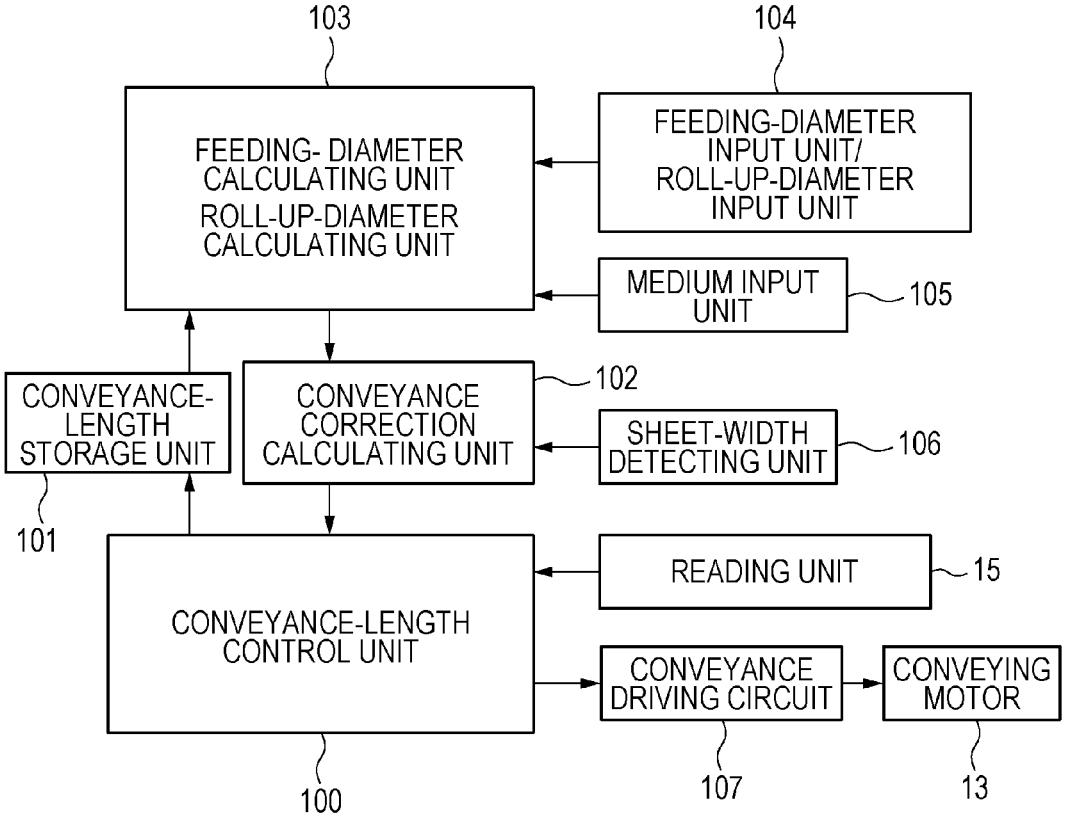
FIG. 4 is a block diagram.

A control sequence will be described with reference to the flow chart in FIG. 3 and the block diagram in FIG. 4. When setting a medium (Step S1), the medium type is input from a medium input unit 105 (Step S2), and the feeding diameter and roll-up diameter of the continuous sheet rolls at the feeding part and the roll-up part, respectively, are input from a feeding-diameter input unit/roll-up-diameter input unit 104 (Step S3). The sheet width is detected by a sensor in a sheet-width detecting unit 106 (Step S4). In this way, an appropriate correction value for the driving amount is selected in the apparatus (Step S5).

A conveyance-correction calculating unit 102 or a conveyance-length control unit 100 has a memory. The memory holds data of tables, such as Table 1, corresponding to each medium with different widths. In Step S5, the correction value of the driving amount corresponding to the feeding diameter and the roll-up diameter is selected on the basis of the input medium type and the table corresponding to the sheet width detected by the sheet-width detecting unit 106.

When there is a printing job to be executed, the correction value for the driving amount is used to drive the conveying motor 13 and perform printing (Step S6). The conveyance distance of the continuous sheet from start to end of the printing is calculated from the driving amount of the conveying motor 13 and is stored in a conveyance length storage unit 101. At the end of printing (Step S7), the current feeding diameter and the current roll-up diameter are calculated using Expressions 1 and 2 based on the stored conveyance distance of the continuous sheet from the start to end of the current printing action, the sheet thickness, and the feeding and roll-up diameters when the sheet rolls were set (Step S8). The total conveyance distance of the continuous sheet after setting the medium is calculated and stored in the conveyance-length storage unit 101. In each of the subsequent printing actions, the conveyance distance is added to the previously recorded total conveyance distance, updating the total conveyance distance. The "conveyance distance" in Expressions 1 and 2 are the updated total conveyance distance.

Next, it is determined whether there is a subsequent printing job (Step S9). When there is a subsequent printing job, a conveyance correction value is reselected on the basis of the diameters (Step S5), and printing is started (Step S6). When there is no subsequent printing job, the process ends (Step S10). In this embodiment, the conveyance correction value is changed between printed pages. Instead, the conveyance correction value may be changed during printing.

In this embodiment, the diameters are determined by calculation. Instead, the diameters may be measured using sensor, such as encoders. The diameters are categorized into three levels, "large," "medium," and "small." Instead, the diameter may be categorized into, for example, five levels, ten levels, or even a single level. An even more appropriate conveyance correction value will be selected when diameters are categorized into a larger number of levels.

When the sheet is conveyed without spooling during printing, a conveyance correction value corresponding to only the feeding diameter may be selected from Table 1 in a manner similar to the related art.

In the first embodiment, conveyance correction is performed in according with the feeding diameter and the roll-up diameter using a conveyance correction table containing data experimentally acquired in advance.

As it is apparent from Table 1, when media of the same type and width have the same feeding diameter, the correction value becomes larger when the roll-up diameter is larger. For example, in Table 1, when the feeding diameter is "small," the correction value is three when the roll-up diameter is "small," four when the roll-up diameter is "medium," and six when the roll-up diameter is "large."

Since the torque applied to the continuous sheet spooled onto the roll-up spool 20 is set constant by the torque limiter 22, the larger the sheet roll diameter is, the smaller the tension applied to the continuous sheet is. Thus, the larger the tension applied to the continuous sheet is, the smaller the correction value is. That is, when a first tension and a second tension, which is larger than the first tension, are applied to the continuous sheet, the correction value is smaller when the second tension is applied to the continuous sheet. In other words, the driving amount of the driving unit per unit conveyance distance when conveying the continuous sheet is smaller when the second tension is applied, compared with when the first tension is applied.

Second Embodiment

A second embodiment will be described. The configuration of the inkjet recording apparatus is the same as that of the first embodiment, and description thereof will not be repeated.

Conveyance Correction

When the medium 3 is conveyed by the conveying roller 11, the medium 3 slips on the conveying roller 11 due to a braking force and a spooling force. By correcting this slippage, high-quality printing can be achieved.

The medium 3 slips a lot when an external force larger than the gripping force (conveying force) of the conveying roller 11 and the pinch roller 16 is applied. In other words, the following expression holds: external force/conveying force=medium slippage. The medium slippage is the slipping rate of the medium with respect to the conveyance length. In other words, the following expression holds: conveyance length×medium slippage×coefficient=medium slippage.

In this embodiment, while being conveyed, the medium 3 receives a braking force from the feeding sheet roll 23 and a spooling force from the roll-up sheet roll 24. At this time, the braking force is the sum of the force generated from the torque limiter 19 of the feeding spool and the inertial and braking force generated when the sheet roll 23 is accelerated, whereas the spooling force is the force generated from the torque limiter 22 of the roll-up spool. These forces are represented by an expression using the feeding diameter and the roll-up diameter to estimate the medium slippage.

Based on rotational balance the following expression holds:

$$I \cdot \frac{d\theta^2}{dt^2} = T_B \cdot r - M_B \tag{3}$$

where $T_B$ represents the braking force received from the feeding sheet roll 23, r represents the sheet roll diameter of the feeding sheet roll 23, I represents the moment of inertia of the feeding sheet roll 23, θ represents the rotational angle of the rolled sheet, and $M_B$ represents the torque of the torque limiter 19.

The moment of inertia I is represented by the following expression:

$$I = \frac{1}{2} \cdot A \cdot (r^2 + C^2) \tag{4}$$

where A represents the mass of the feeding sheet roll 23, r represents the sheet roll diameter of the feeding sheet roll 23, and C represents the cylinder diameter of the sheet roll 23.

The mass A of the feeding sheet roll 23 is represented by the following expression:

$$A=(r^2-C^2)\cdot\pi\cdot L\cdot m \tag{5}$$

where L represents the sheet width of the feeding sheet roll 23 and m represents unit mass.

The relationship represented by the following expression holds:

$$r \cdot \frac{d\theta^2}{dt^2} = \alpha \tag{6}$$

where θ represents the rotational angle of the feeding sheet roll 23, r represents the sheet roll diameter of the feeding sheet roll 23, and α represents the conveying acceleration of the medium 3.

$T_B$ represents the braking force is represented by the following expression:

$$T_B = \frac{1}{2} \cdot \pi \cdot m \cdot L \cdot \alpha \cdot \left\{ r^2 - \left( \frac{C^2}{r} \right)^2 \right\} + \frac{M_B}{r} \tag{7}$$

When the medium 3 is spooled onto the roll-up sheet roll 24 at constant speed, the rotational balance is represented by the following expression:

$$T_F = \frac{M_F}{R} \tag{8}$$

where $T_F$ represents the spooling force received from the roll-up sheet roll 24, $M_F$ represents the torque of the torque limiter 22, and R represents the diameter of the roll-up sheet roll 24. Thus, the external force T applied to the medium 3 is $T=T_B-T_F$ and is represented by the following expression:

$$T = \frac{1}{2} \cdot \pi \cdot m \cdot L \cdot \alpha \cdot \left\{ r^2 - \left( \frac{C^2}{r} \right)^2 \right\} + \frac{M_B}{r} - \frac{M_F}{R} \tag{9}$$

Sliding load applied between the medium 3 and the apparatus is very small and is not included in Expression 8. However, sliding load data obtained, for example, through experiments may be added as a constant term to correct Expression 8.

The medium conveying force P is represented by the following expression P=p·L where p represents the conveying force per unit width and L represents the width of the medium 3.

Thus, the medium slippage s is s=T/P and is represented by the following expression:

$$s = \frac{1}{2 \cdot p} \cdot \pi \cdot m \cdot \alpha \cdot \left\{ r^2 - \left( \frac{C^2}{r} \right)^2 \right\} + \frac{1}{p \cdot L} \cdot \left( \frac{M_B}{r} - \frac{M_F}{R} \right) \tag{10}$$

The medium slippage can be represented as (conveyance length)×(medium slippage)×(coefficient), and specifically, the medium slippage Δx is represented by the following expression:

$$\Delta x = k \cdot \left\{ (y-\gamma) \cdot \left\{ \frac{1}{2 \cdot p} \cdot \pi \cdot m \cdot \alpha \cdot \left\{ r^2 - \left( \frac{C^2}{r} \right)^2 \right\} \right\} + (y+z-\gamma) \cdot \left\{ \frac{1}{p \cdot L} \cdot \left( \frac{M_B}{r} - \frac{M_F}{R} \right) \right\} \right\} \tag{11}$$

where k represents a coefficient, y represents an accelerating-region conveyance length, z represents a constant-speed-region conveyance length, γ represents the medium looseness, p represents the conveying force per unit width, m presents the unit mass, α represents conveyance acceleration, C represents the sheet cylinder diameter, L represents the width of the medium 3, $M_F$ represents the torque of the torque limiter 22, r represents the sheet roll diameter of the feeding sheet roll 23, and $M_B$ represents the torque of the torque limiter 19.

Accordingly, the slippage Δx is estimated for the conveyance distance x=(accelerating-region conveyance length y)+(constant-speed-region conveyance length z)+(decelerating-region conveyance length y). By adding the driving amount to convey the slippage Δx as a correction value to the theoretical driving amount, the actual conveyance distance approaches the target conveyance distance. The expression h=Δx/X1 holds, where h represents the pulse count of the correction value and X1 represent the conveyance distance corresponding to one pulse count of the motor drive. Thus, the conveyance correction value corresponding to the roll-up diameter and the feeding diameter of a medium in an apparatus can be estimated. When the conveyance distance x is the unit conveyance distance of the apparatus, h represents a correction value per unit conveyance distance.

The feeding diameter r and the roll-up diameter R may be determined in a manner similar to that in the first embodiment through calculation of the initial feeding diameter, the initial roll-up diameter, the conveyance length, and the sheet thickness or may be measured using a sensor. The looseness γ may also be measured by a sensor, or experimentally acquired data may be used.

Figure 5:
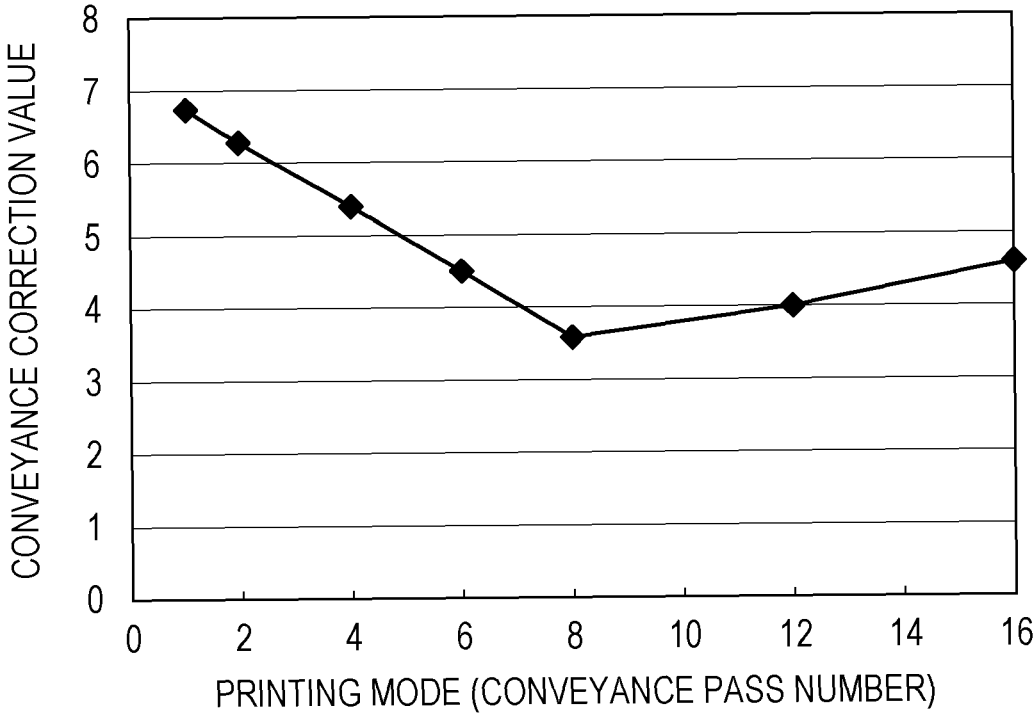
FIG. 5 illustrates a conveyance correction value in each printing mode (conveying pass).

When the printing mode (conveying pass) is changed at a certain diameter, the values of the accelerating-region conveyance length y and the constant-speed-region conveyance length z are changed in the expression representing the medium slippage Δx to estimate the conveyance correction value, such as in FIG. 5.

When performing printing while conveying the medium 3 without spooling, the conveyance correction value is estimated using the above-described expression, where $M_F=0$.

In the second embodiment, the spooling force and the braking force are calculated in accordance with various parameters including the roll-up diameter and the feeding diameter, and the slippage is estimated from the calculation associated with the conveyance length to perform conveyance correction.

When Expression 11 is expanded, the term $-(y+z-\gamma)(1/pL)M_F/R$ is included. This term indicates that when the conditions are the same, the correction value h becomes larger as the roll-up diameter becomes larger.

Third Embodiment

A third embodiment will be described. The configuration of the inkjet recording apparatus is the same as that of the first embodiment, and description thereof will not be repeated.

Conveyance Correction

Depending on the medium, when the diameter of the roll is small, the medium may be tightly curled. In the second embodiment, conveyance resistance due to such curling of the medium is not considered. The external force T in the second embodiment may be corrected using the expression $T=T_B-T_F+P(r,R)$, where P(r,R) represents the curling conveyance resistive force associated with the diameter of the roll. P(r,R) is corrected on the basis of data experimentally acquired in advance.

Fourth Embodiment

A fourth embodiment will be described. The configuration of the inkjet recording apparatus is the same as that of the first embodiment, and description thereof will not be repeated.

Conveyance Correction

In the second and third embodiments, the spooling force and the feeding braking force are calculated from various parameters to estimate the conveyance correction value. In this embodiment, these forces are directly measured by sensors installed in the apparatus to perform conveyance correction.

For conveyance correction according to the second, third, and fourth embodiments, the conveyance correction value may be set to correspond to each diameter or may be set in accordance with the level ("large," "medium," and "small") of the diameter, such as in the first embodiment.

Fifth Embodiment

Figure 6:
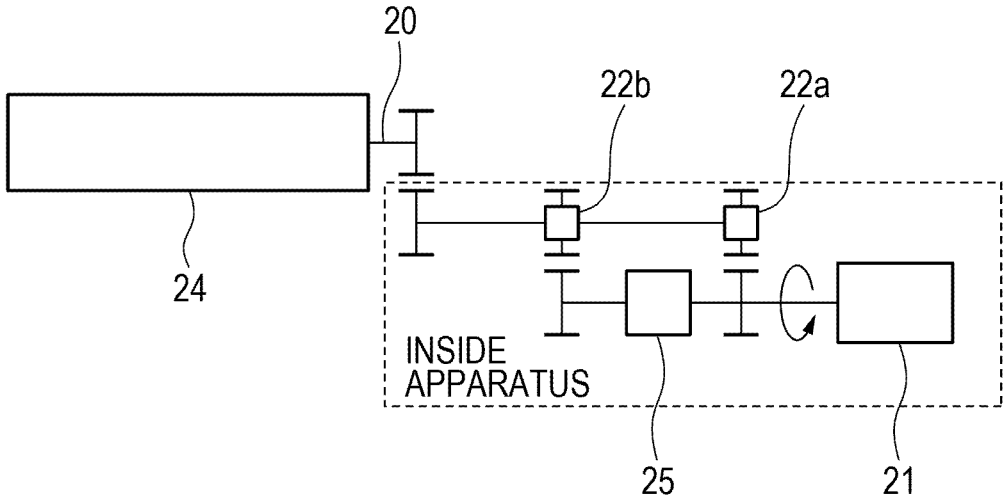
FIG. 6 is a schematic view of a spooling force switching mechanism.

A fifth embodiment will be described. The configuration of the inkjet recording apparatus is the same as that of the first embodiment, and description thereof will not be repeated. The configuration of the spooling device that differs from that of the first embodiment will be described below. After printing is performed on the medium 3 by the print head 7, the medium 3 is spooled onto the roll-up spool 20 into the roll-up sheet roll 24. FIG. 6 is a detailed drawing of the roll-up spool 20 and the periphery (schematic view of a spooling-force switching mechanism). The roll-up spool 20 receives a driving force from the roll-up motor 21, which is disposed inside the recording apparatus, and rotates via a first torque limiter 22*a*, a second torque limiter 22*b*, an electromagnetic clutch 25, and an idler gear (not shown), which are also disposed inside the recording apparatus. The driving of the roll-up motor 21 causes tension (spooling force) to be applied to the medium 3 between the nip of the conveying roller 11 and the roll-up sheet roll 24. When the electromagnetic clutch 25 is turned off, only the first torque limiter 22*a* operates, whereas when the electromagnetic clutch 25 is turned on, the first torque limiter 22*a* and the second torque limiter 22*b* operate. In this way, the spooling force can be switched between two levels.

Conveyance Correction

In this embodiment, the spooling force is switched in accordance with the medium type. For example, a medium that easily adheres to the platen is conveyed with the spooling force set to a high level, whereas a medium that may become wrinkled when the spooling force is large is conveyed with the spooling force set to a low level. By changing the conveyance correction value in accordance with the spooling force, high-quality printing can be achieved. In addition, as in the first to fourth embodiments, by changing the conveyance correction value in accordance with the roll-up diameter and the feeding diameter, high-quality printing is achieved. In this embodiment, the spooling force is switched between two different levels. Instead, the spooling force may be switched among three levels or may not have any definite levels. In such cases, also, the correction value is changed in accordance with the spooling force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-189459 filed Aug. 26, 2010, which is hereby incorporated by reference herein in its entirety.

What is claimed is:

1. A sheet conveying device comprising:

a rolled-sheet supporting unit configured to support a continuous sheet rolled up into a roll;

a conveying unit configured to convey the continuous sheet from the rolled-sheet supporting unit;

a driving unit configured to drive the conveying unit;

a tension applying unit disposed downstream of the conveying unit, configured to apply tension to the continuous sheet in a conveying direction; and a control unit configured to control a driving amount of the driving unit per unit conveyance distance as the conveying unit conveys the continuous sheet, so that the driving amount of the conveying unit in a case where a first tension is applied by the tension applying unit is larger than the driving amount of the conveying unit in a case where a second tension, that is larger than the first tension, is applied.

2. The sheet conveying device according to claim 1, wherein the tension applying unit includes a spool configured to spool the continuous sheet downstream of the conveying unit and a roll-up driving unit configured to drive the spool via a torque limiter.

3. The sheet conveying device according to claim 1, wherein the continuous sheet is spooled at substantially constant speed.

4. The sheet conveying device according to claim 3, wherein tension changes in accordance with a roll diameter of the continuous sheet wound around the spool.

5. The sheet conveying device according to claim 4, further comprising:

a memory holding a correction table for correcting the driving amount in accordance with the roll diameter of the continuous sheet rolled up around the spool, wherein the control unit controls the driving unit to drive the conveying unit by a driving amount corrected by a correction value acquired from the correction table.

6. The sheet conveying device according to claim 1, wherein the control unit controls the driving unit to drive the conveying unit by a driving amount corrected with a correction value corresponding to the tension applied to the continuous sheet by the tension applying unit.

7. A recording apparatus comprising:

a sheet conveying device according to claim 1; and a recording unit recording on a continuous sheet conveyed by the sheet conveying device.

8. A sheet conveying device comprising:

a rolled-sheet supporting unit configured to support a continuous sheet rolled up into a roll;

a conveying unit configured to convey the continuous sheet from the rolled-sheet supporting unit;

a driving unit configured to drive the conveying unit;

a spool configured to spool the continuous sheet downstream of the conveying unit;

a roll-up driving unit configured to drive the spool via a torque limiter; and a control unit configured to control a driving amount of the driving unit per unit conveyance distance as the conveying unit conveys the continuous sheet, so that the driving amount of the conveying unit in a case where a roll diameter of the continuous sheet rolled up around the spool is a first roll diameter is smaller than the driving amount of the conveying unit in a case where the roll diameter is a second diameter that is larger than the first diameter.

9. The sheet conveying device according to claim 8, wherein the continuous sheet is spooled at substantially constant speed.

10. The sheet conveying device according to claim 8, wherein the roll diameter of the continuous sheet wound around the spool is calculated from a conveyance distance of the continuous sheet and a thickness of the continuous sheet.

11. The sheet conveying device according to claim 8, further comprising:

a roll-diameter input unit configured to receive the roll diameter of the continuous sheet wound around the spool, wherein the roll diameter is calculated from a total conveyance distance of the continuous sheet after the roll diameter is input and a thickness of the continuous sheet.

12. A sheet conveying device comprising:

a rolled-sheet supporting unit configured to support a continuous sheet rolled up into a roll;

a conveying unit configured to convey the continuous sheet from the rolled-sheet supporting unit;

a driving unit configured to drive the conveying unit;

a spool disposed downstream of the conveying unit, configured to spool the continuous sheet;

a roll-up driving unit configured to drive the spool with a torque limiter; and a control unit configured to control the driving unit, wherein, as the conveying unit conveys the continuous sheet, a driving amount of the driving unit per unit conveyance distance is corrected by a correction value corresponding to a roll diameter of the continuous sheet wound around the spool.

13. The sheet conveying device according to claim 12, wherein the control unit acquires at least one of a correction value from a correction table for acquiring a correction value corresponding to the roll diameter of the continuous sheet wound around the spool and a correction value determined through calculation.

14. The sheet conveying device according to claim 12, wherein, the roll-up driving unit select the tension applied to the continuous sheet, and the control unit sets the correction value in accordance with the selected tension.

15. The sheet conveying device according to claim 12, wherein the control unit sets the correction value in accordance with either a width of the continuous sheet, a type of the continuous sheet, a printing mode (pass number), a thickness of the continuous sheet or curling of the continuous sheet.

16. The sheet conveying device according to claim 12, wherein the continuous sheet is spooled at substantially constant speed.

17. A sheet conveying device comprising:

a supporting unit configured to support a continuous sheet rolled up into a roll;

a resisting torque applying unit configured to apply a resisting torque to resist rotation of the roll supported by the supporting unit;

a conveying unit configured to convey the continuous sheet from the rolled-sheet supported by the supporting unit;

a driving unit configured to drive the conveying unit;

a spool configured to spool the continuous sheet downstream of the conveying unit;

a roll-up driving unit configured to drive the spool via a torque limiter; and a control unit configured to control the driving unit so that a driving amount of the driving unit per unit conveyance distance is corrected by a correction value corresponding to a roll diameter of the continuous sheet wound around the spool.

18. The sheet conveying device according to claim 17, wherein the control unit controls the driving unit so that the correction value is larger in a case where the roll diameter of the continuous sheet wound around the spool is a first diameter compared to a case in which the roll diameter of the continuous sheet wound around the spool is a second diameter that is smaller than the first diameter.

19. The sheet conveying device according to claim 17, wherein the control unit controls the driving unit so that the correction value is larger in a case where the roll diameter of the roll supported by the supporting unit is a third diameter compared to a case in which the roll diameter of the roll supported by the supporting unit is a forth diameter that is smaller than the third diameter.

20. The sheet conveying device according to claim 17, wherein the continuous sheet is spooled at substantially constant speed.

* * * * *